United States Patent [19]

Jauch

[11] Patent Number: 4,697,999

[45] Date of Patent: Oct. 6, 1987

[54] ROTARY PISTON ENGINE

[76] Inventor: Kurt Jauch, Stritzling 191, 8351 Lalling, Fed. Rep. of Germany

[21] Appl. No.: 807,033

[22] Filed: Dec. 9, 1985

[30] Foreign Application Priority Data

Dec. 17, 1984 [DE] Fed. Rep. of Germany ..... 3445979
Nov. 29, 1985 [EP] European Pat. Off. ..... 85115187.8

[51] Int. Cl.[4] ..... F01G 1/18
[52] U.S. Cl. ..... 418/191; 418/206
[58] Field of Search ..... 418/191, 206, 19

[56] References Cited

U.S. PATENT DOCUMENTS 1,257,744 2/1918 Schorr ..... 418/206
2,451,603 10/1948 Barker ..... 418/206
3,799,713 3/1974 Cloots ..... 418/206

FOREIGN PATENT DOCUMENTS 246546 of 1910 Fed. Rep. of Germany ..... 418/206
207065 11/1923 United Kingdom ..... 418/206

*Primary Examiner*—Leonard E. Smith
*Assistant Examiner*—Jane E. Obee
*Attorney, Agent, or Firm*—Browdy and Neimark

[57] ABSTRACT

A casing (10) is formed with two cylinder chambers (21, 22) in overlapping arrangement between an inlet (43) and an outlet (44). A rotary piston (27, 28) each is fixed to a respective one of two shafts (17, 18) extending through a cylinder chamber (21, 22) each and being interconnected for rotation in opposite sense. The rotary pistons (27, 28) are complementary and each have an exterior face (29, 30) coaxial with the corresponding shaft (17, 18), the exterior faces periodically forming sealing zones with the casing (10) and with a respective exterior face (38, 37) of respective sleeve (35, 36) each which is coaxial with the shaft (18, 17) of the complementary rotary piston (28, 27). Each sleeve (35, 36) is sealingly arranged and rotatable between a respective one of the rotary pistons (27, 28) and the corresponding shaft (17, 18). The exterior faces (29, 30) of each complementary rotary piston periodically engage the exterior faces (37, 38) of each sleeve to periodically drive in rotation each sleeve (35, 36) at a speed greater than that of the corresponding rotary piston (27, 28) and shaft (17, 18). In this manner flow losses and control problems caused by the same are largely avoided.

12 Claims, 5 Drawing Figures

ROTARY PISTON ENGINE

The instant invention relates to a rotary piston engine, comprising a casing in which two cylinder chamber are formed so as to overlap each other between an inlet and an outlet, further comprising two shafts each extending through a respective one of the cylinder chambers and both being interconnected for rotation in opposite sense, and two rotary pistons complementary to each other and each fixed to a respective one of the shafts and including a first or exterior surface coaxial with the corresponding shaft, the exterior faces periodically forming sealing zones with the casing and with a respective second or exterior surface each of which is coaxial with the shaft of the complementary rotary piston, in the overlapping area of the two cylinder chambers.

Rotary piston engines of this kind have been known for a long time, for instance, from German patent No. 23 243 and British patent No. 575 350 as well as published German patent application No. DE-AS 1 002 562. In the case of these known engines the rotary pistons have a peripheral surface which totally encloses the corresponding shaft. The rotary pistons mesh in the manner of gears and their peripheral surfaces roll off each other if either one of the two shafts is driven so that the rotary piston engine, embodying a pump or fan, will convey a fluid or if a pressurized fluid is supplied to the machine to drive either one of the two rotary pistons to cause the machine to supply a torque in the manner of a drive engine.

The rotary pistons meshing like gears in known machines of the same generic kind in question may roll off each other in nonslipping fashion only at such points at which imagined pitch circles of the two rotary pistons contact each other, just like regular gears. If the two shafts are interconnected as usual by directly meshing gears of the same size, then their pitch circles as well as the pitch circles of the two rotary pistons are of the same size. Their diameter corresponds to the spacing between axes of the two shafts. Slipping is superposed over the roll-off movement of the two rotary pistons at all points not located on the respective pitch circle. And this slipping increases at increasing distance from the pitch circle, reaching its maximum whenever a cylindrical exterior face of one rotary piston rolls off a cylindrical exterior face of the other rotary piston.

In operation this slipping may cause considerable frictional losses and lead to quick destruction of the peripheral surfaces of the rotary pistons. It is customary with machines of the generic type in question to prevent that by selecting the center distance of the two shafts such that a gap will always remain free between the associated exterior faces of the two rotary pistons. In inoperative condition this gap must be rather large because during operation the two shafts may be bent towards each other by compressive forces of the flowing medium. The gap between head and foot faces which thus roll off each other in theory only, has the disadvantage that a considerable portion of the flowing medium, particularly when operating at partial load, passes between the two rotary pistons, causing output losses and making it difficult if not impossible to control such known machines. The control behavior is especially poor at partial load operation if known machines of the generic type in question are used as hydraulic or pneumatic rotary piston drive engines. They may stop suddenly if a certain rate of fluid flow per unit time is fallen short of because all of the fluid passes by between the rotary pistons.

It is, therefore, an object of the invention to develop a rotary piston engine such that the losses of flow are reduced and affect the control behavior of the engine less than before, inasmuch as they are unavoidable.

This object is met, in accordance with the invention, in a rotary piston engine of the kind recited initially, in that at least one sleeve is arranged between each rotary piston and the corresponding shaft to periodically establish sealing with respect to the complementary rotary piston, the sleeve being supported for rotation on the corresponding shaft and forming an exterior face which is coaxial with the shaft, where the exterior face of each complementary piston periodically engage the exterior face of each sleeve to periodically drive in rotation each sleeve at a speed greater than that of the corresponding rotary piston and shaft.

This rolling off without clearance between the exterior faces practically totally prevents the hydraulic or pneumatic delivery of working medium by which the rotary piston engine according to the invention is operated as a pump or drive engine from passing between the surfaces mentioned. Losses of flow between the casing and the head faces as well as the end faces of the rotary pistons may be kept quite low, as with known rotary piston engines of the same generic kind. With the engine according to the invention thus the losses of flow are small on the whole and consequently without any substantial influence on the control behavior.

At the same time frictional resistances and the loss they cause are kept extremely low with the invention because the journalling of the sleeves according to the invention makes it possible for their shell surfaces serving as exterior faces to roll off the exterior faces of the rotary pistons in substantially nonslipping manner. Some minor slipping, if any, may occur at the beginning of the engagement of an exterior face of the piston with an exterior face of the sleeve foot until this exterior face of the sleeve will have been accelerated to a circumferential speed corresponding to that of the exterior face of the piston. However, as the sleeves are rotatable, it is impossible for any wear to concentrate at a particular location. To the extent that the exterior faces of the sleeves wear at all, such wear is so uniform that the exterior faces of the sleeves remain round.

The rotary piston engine in accordance with the invention may be developed further in that the sleeves are supported on the corresponding shaft by at least one roller or ball bearing each, and in that each sleeve is periodically driven in rotation by the engagement of the exterior face of the complementary rotary piston.

This measure affords further improvement of the sealing between exterior faces, keeping their wear at an especially low level.

It is especially advantageous for each of the shafts to be connected by a freewheel to each of the sleeves it carries. It will thus be prevented that the rotational speed of the sleeves is reduced periodically by frictional resistance to a level which is lower that the rotational speed of the respective shaft.

A preferred embodiment of the invention further is characterized in that each rotary piston is connected with the corresponding shaft by at least one annular web, and in that each sleeve is sealingly arranged axially next to the corresponding web.

This embodiment may be developed further in that two sleeves separated from each other by a centrally disposed web are supported on each of the shafts, in that the sleeves each has an end face remote from the corresponding web, which seals against the casting and in that the webs have a slightly smaller outer diameter than the corresponding sleeves.

The invention will be described further, by way of example, with reference to the accompanying drawings, in which.

Figure 1:
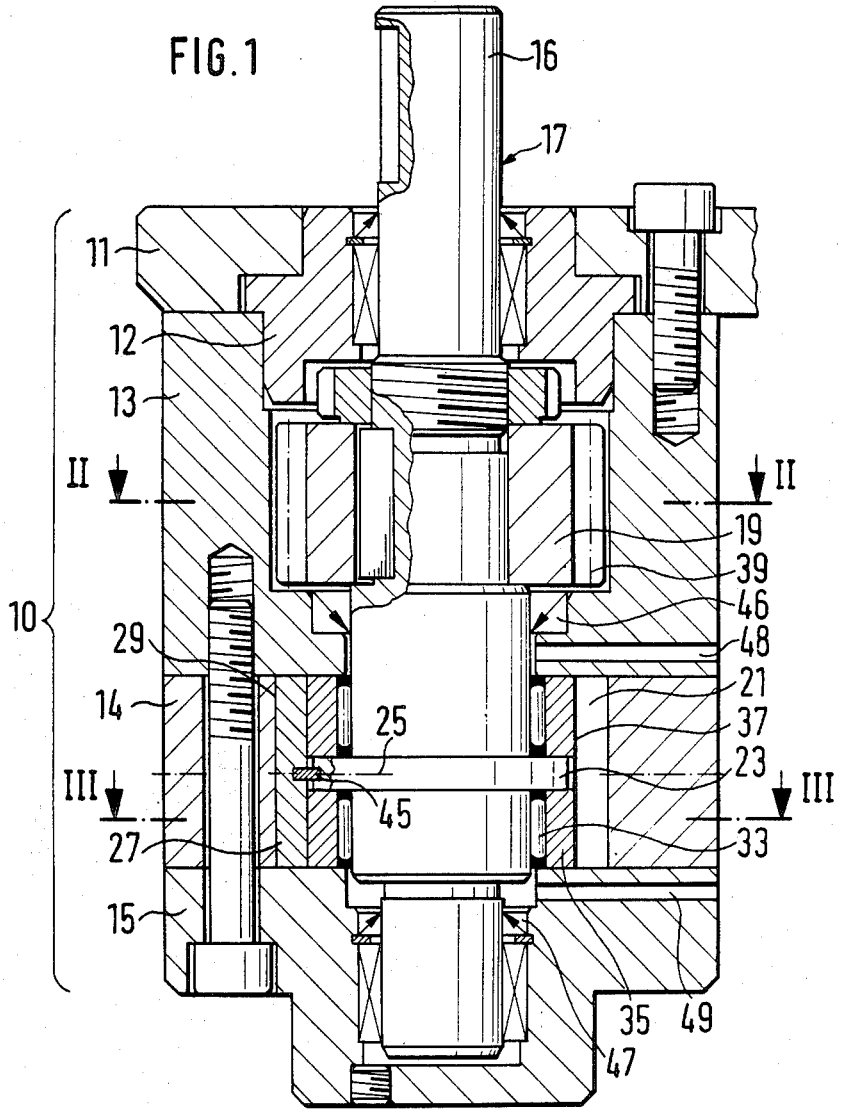
FIG. 1 is a longitudinal sectional view of a rotary piston engine according to the invention.
Figure 2:
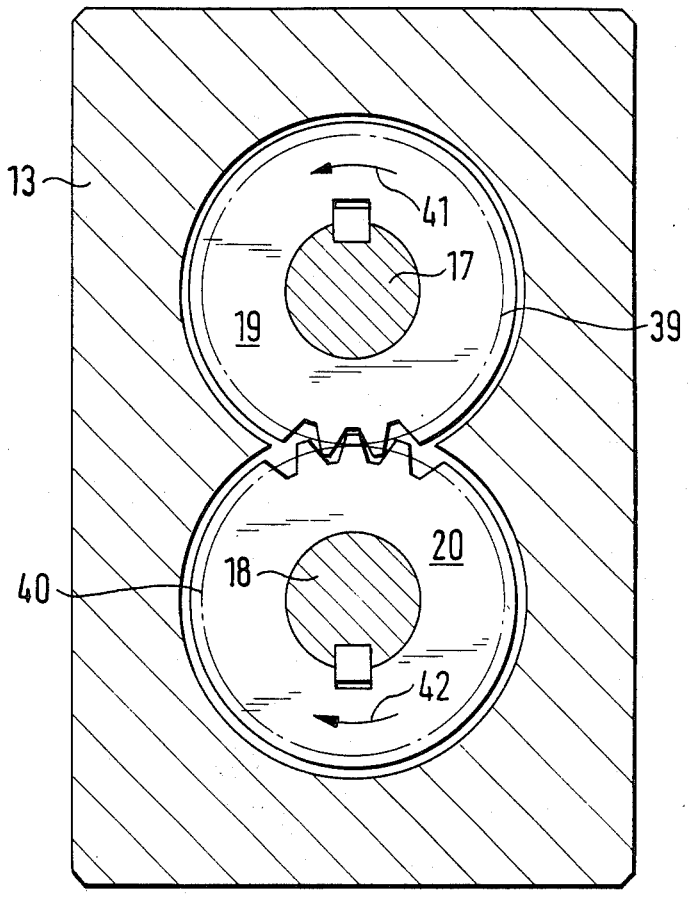
FIG. 2 is the cross sectional view along lines II—II of FIG. 1.
Figure 3:
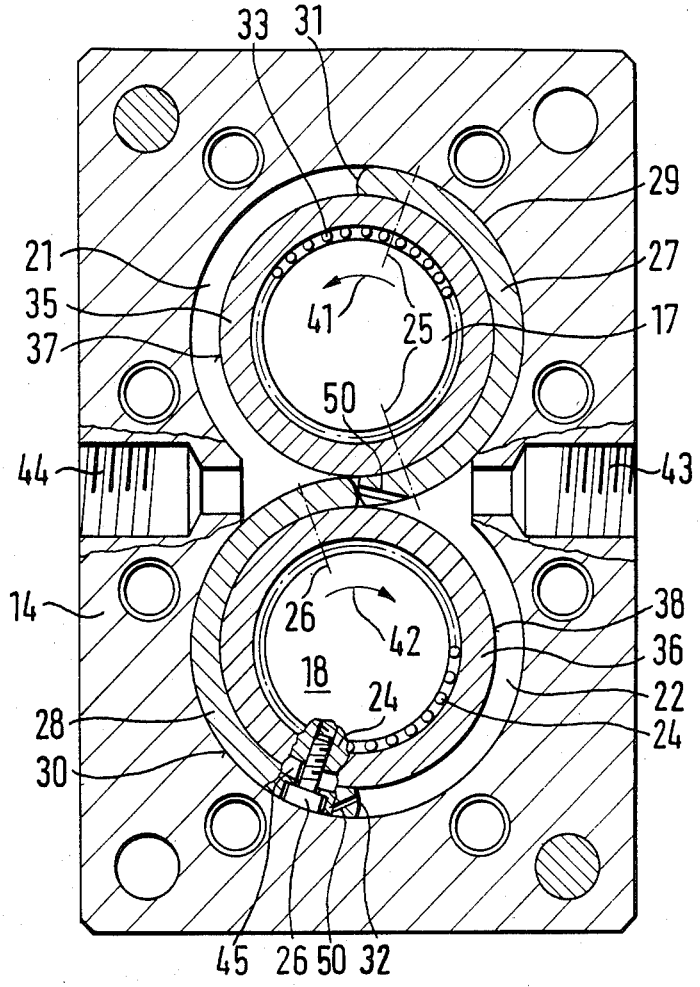
FIG. 3 is the cross sectional view along lines III—III of FIG. 1.

The rotary piston engine illustrated in FIGS. 1 to 3 comprises a casing 10 substantially composed of an upper cover plate 11, as seen in FIG. 1, configured like a spectacle frame and having two supporting inserts 12, only one of which is shown, and a frame-like gear plate 13, a likewise frame-like cylinder plate 14, as well as a lower cover plate 15. A journal 16 of a shaft 17 extends through the supporting insert 12 shown. The shaft 17 and another shaft 18 are supported in parallel in respective ones of the supporting inserts 12 each and in the lower cover plate 15.

A gear 19 and 20, respectively, is fixed on either shaft 17 and 18 within the frame-like gear plate 13. These two gears are identical and mesh almost without clearnace, as may be taken from FIG. 2.

As shown in FIG. 3, two cylinder chambers 21 and 22 are formed to be coaxial with a respective one of the two shafts 17 and 18, and their diameter is somewhat greater than the center spacing of the two shafts whereby the two cylinder chambers overlap. Within the axially central range of each cylinder chamber 21 and 22, the corresponding shaft 17 and 18 is formed integrally with a web 23 and 24, respectively, of circular ring shape.

Rotary pistons 27 and 28, substantially in the shape of a sector of a circular ring, are each fastened by screws 25 and 26, respectively, or by soldering or spot-welding and the like, to a respective web 23, 24. The rotary pistons 27 and 28 each include a radially outer circumferential surface or face 29 and 30, respectively, of the shape of a circular cylinder and in engagement almost without clearance with the wall of the corresponding cylinder chamber 21 and 22, thus establishing sealing with respect to the same. As shown in FIG. 3, each of the two rotary pistons 27, 28 extends through an arc of 180° C., being defined in circumferential direction by two involute flanks 31 and 32, respectively. Laterally each rotary piston 27, 28 is in sealing engagement by a planar end face with the gear plate 13 and the lower cover plate 15, respectively, as may be taken from FIG. 1.

A roller or needle bearing 33 and 34 or a pair of ball bearings each is arranged on each shaft 17 and 18 at both sides of the corresponding annular web 23 and 24, and a sleeve 35 or 36, respectively, of hardened steel is supported on the respective bearing. Both sleeves 35 and 36 have an outer surface of the shape of a circular cylinder in engagement substantially without clearance, and thus sealingly, with a corresponding inner surface of the corresponding rotary piston 27 and 28. These outer surfaces will be referred to below as exterior sleeve faces 37 and 38. The sleeves 35 and 36 are completely identical, their exterior faces 37 and 38 having a diameter which is just slightly greater, by a few hundreds of a millimeter, at best, than the outer diameter of the corresponding annular web 23 or 24 and so selected that each exterior face 37, 38 of a sleeve 35 or 36 is adapted to engage the exterior face of the complementary rotary piston in order to periodically drive the sleeve in rotation.

Regardless of whether the rotary piston engine shown works as a pump or drive engine, the two shafts 17 and 18 rotate in the directions of the arrows 41 and 42, respectively. In this manner a pneumatic or hydraulic delivery or operating medium will pass through an inlet 43 into the overlapping area of the two cylinder chambers 21, 22 and then flow out through an outlet 44. At every possible angular position of rotation of the two shafts 17, 18, the inlet 43 and the outlet 44 are separated from each other by the rotary pistons 27, 28 and the sleeves 35, 36.

By its radially inner cylindrical surface each rotary piston 27, 28 is in engagement with the exterior face 37 and 38, respectively, of the corresponding sleeve 35 and 36 such as to tend to take along the latter at the same angular speed as the two shafts 17 and 18. In the course of each revolution of the shafts 17 and 18 the respective exterior face 29 or 30 of the rotary pistons 27, 28 enters into temporary engagement with the respective exterior face 38 or 37 of the opposite sleeves 35, 36. Hereby the respective sleeve is accelerated such that its exterior face attains the circumferential speed of the exterior face of the rotary piston rolling off on it, whereby this roll-off motion takes place without slipping. The angular speed of the respective sleeve 35 or 36 thus increases for some time, this being half a revolution in the case of the embodiment shown in FIGS. 1 to 3.

As the roll-off movement is completed, the angular speed of the respective sleeve 35 or 36 drops again to the value of the angular speed of the respective coaxial shaft 17 or 18. The periodic acceleration of the sleeves 35 and 36 needed for their rolling off without clearance on the rotary pistons 28 and 27, respectively, takes place almost instantaneously because the sleeves have only little masses of inertia By each of their end faces the sleeves 35 and 36 abut against the gear plate 13 and the cover plate 15, respectively. The sleeves 35 and 36 should be fitted as tightly as possible between the gear plate 13 and the cover plate 15 so as assure the desired sealing. However, this will give rise to frictional resistances and, as a consequence, the sleeves 35 and 36 may be slowed down and even come to a stop periodically during the intervals when they are not driven by one of the rotary pistons 28 and 27, respectively, rolling off the same. Therefore, the needle bearings 33 and 34 preferably are designed as freewheel means to prevent such substantial slowdown of the sleeves 35 and 36. These freewheel means guarantee the positive driving of the sleeves 35 and 36 in the direction of the arrows 41 and 42, respectively.

Following from the description above, in each of the three embodiments of the invention as shown in FIGS. 1 to 3, 4 and 5, shaft 17, gear 19 and piston (or pistons) 27 are adapted to rotate together (as indicated by arrow 41), whereas shaft 18, gear 20 and piston (or pistons) 28 are adapted to rotate together (as indicated by arrow 42). Sleeve 35 is basically free to rotate on shaft 17. Sleeve 36 is basically free to rotate on shaft 18. However, the outer or exterior face 29 of piston 27 periodically engages the outer or exterior face 38 of sleeve 36 for a certain time interval, corresponding to an angle of rotation of 180° in the embodiment of FIGS. 1 to 3. Therefore, the sleeve 36 is periodically driven in rotation by the piston 27 at an angular speed greater than that of the shaft 18 and its piston (or pistons) 28. FIG. 3 shows the engine in a position at the end of a time interval during which piston 27 has driven sleeve 36 by a practically nonslipping frictional engagement. Consequently, corresponding to 180° in the embodiment of FIGS. 1 to 3, the piston 28 drives the sleeve 35 at an angular speed greater than that of the shaft 17. In each case, the difference in angular speeds is due to the difference in diameters of the exterior faces 29 and 30 and the associated exterior faces 38 and 37, of the sleeves, respectively.

From the preceding, it is seen that the sleeves 35 and 36 are not driven by the rotary pistons 28 and 27 during the time intervals where there is no contact between these sleeves and pistons. For instance, in the position shown in FIG. 3 and with the directions of rotation indicated by arrows 41 and 42, the sleeve 36 is about to loose contact with the piston 27 whereas the sleeve 35 starts having contact with piston 28. Therefore, sleeve 35 will be driven for an approaching time interval whereas sleeve 36 ceases to be driven in the same time interval.

The periodic driving of the sleeves 35 and 36 serves a purpose of enabling a constant and practically nonslipping engagement between the structural members centered around the shaft 18.

As above, in order to avoid complete stops at the sleeves 35 and 36 in the alternating time intervals when they are not driven by an associated piston or pistons 28 and 27, the bearings 33 and 34 may be so designed that they act as "freewheel" or "one way clutches", such as are generally known e.g. with bicycles.

Figure 4:
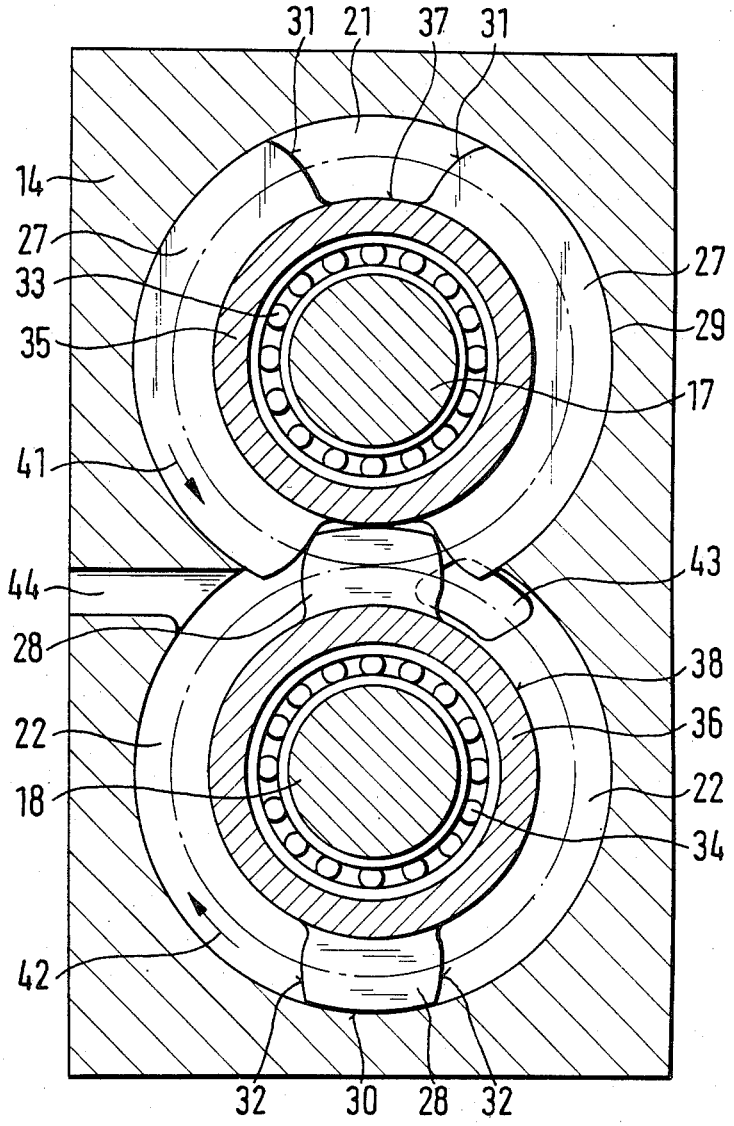
FIG. 4 is a cross sectional view similar to FIG. 3 of modified rotary piston engine and FIG. 5 is a cross sectional view similar to FIG. 3 of a further modified rotary piston engine.

The rotary piston engine shown in FIG. 4 differs from the embodiment according to FIGS. 1 to 3 in that each of the two rotary pistons 27 and 28 is divided into two portions of the shape of a sector of a circular ring, both of the same size, these portions being fixed to the corresponding shaft 17 or 18 at diametrically opposed locations. By virtue of this arrangement the shafts 17, 18 are free of imbalance so that the rotary piston engine is suitable for higher rotational speeds.

In the example shown in FIG. 4 the two portions of the rotary piston 27 each extend through some 150°, while the two portions of the rotary piston 28 each cover a range of approximately 30°. As with the embodiment according to FIGS. 1 to 3, therefore, the two rotary pistons 27 and 28 add up to 360°, minus a small angle which corresponds to the minor clearance between the meshing flanks 31 and 32. The engine shown in FIG. 4 is primarily adapted to be operated by pressurized air.

Figure 5:
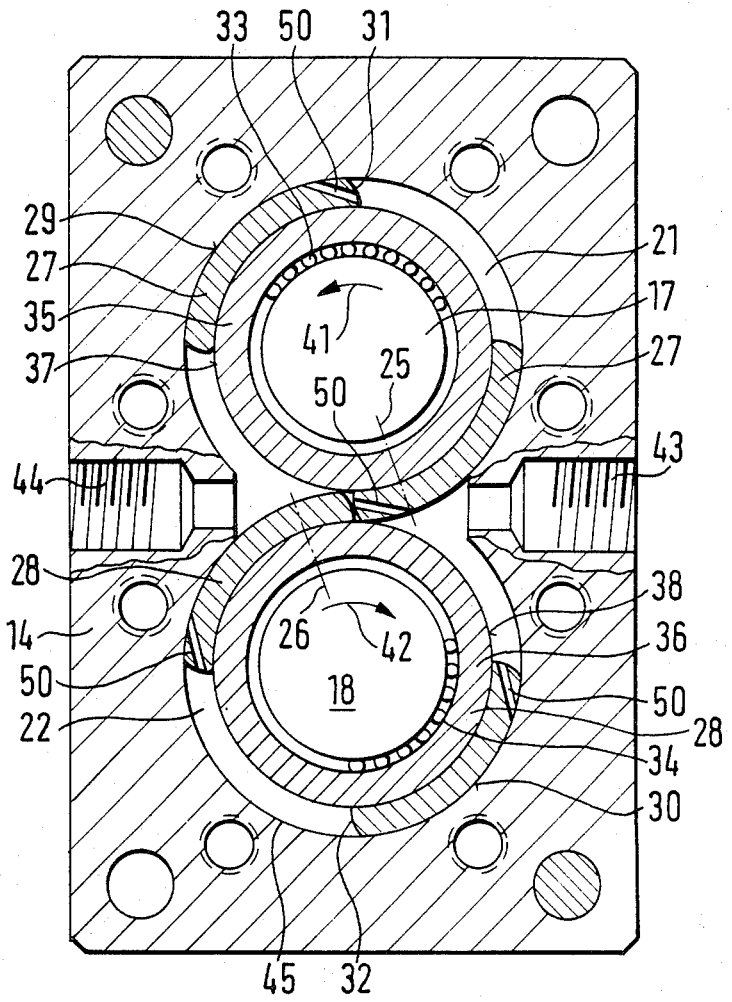

FIG. 5 shows a further embodiment which is primarily adapted to be operated as a fast-running oil-driven engine. This embodiment may be considered a synthesis of the two previous embodiments. A common feature of the embodiment of FIGS. 1 to 3 and the instant embodiment resides in rotary pistons of equal size being associated with both shafts 17 and 18. A common feature of the embodiment of FIG. 4 and the instant one resides in a pair of diametrically opposed pistons 27 or 28 being associated with each shaft 17 and 18, respectively. Thus, in accordance with FIG. 5, each rotary piston 27 and 28 extends through an angular range of 90°. In this manner it becomes possible for the engine to rotate particularly smoothly even at speeds as high as 6000 r.p.m.

In the case of both embodiments, the one shown in FIGS. 1 to 3 as well as the one according to FIG. 4, a fitting piece 45 may be inserted, as shown in FIGS. 1 to 3, between each web 23, 24 and the corresponding rotary piston 27 or 28 to improve the accuracy of the connection between the respective web and the corresponding rotary piston.

The shafts 17 and 18 may be sealed directly axially adjacent the cylinder chambers 21 and 22. Yet it is more advantageous if shaft seals 46 and 47 each are arranged axially spaced from the two cylinder chambers 21 and 22 and a pressure relief passage 48 and 49, respectively, is formed in the lower cover plate 15 between them. These pressure relief passages 48, 49 either communicate with atmosphere, as shown in FIG. 1, or they lead to an oil reservoir and the like, depending on the kind of delivery or operating medium of the rotary piston engine.

The early formation of an oil pressure or other fluid pressure between the flanks 31 and 32 cooperating in pairs can be enhanced by passages 50 starting from the exterior faces 29 and 30 of the piston 27, 28 in the area of the cylinder chambers 21, 22 exposed to higher pressure and opening at the respective adjacent flank 31 or 32. Such passages 50 take the course shown in FIG. 3 for example in the rotary piston 27 when the rotary piston engine operates as a drive engine, being supplied with pressurized oil and the like through inlet 43. In longitudinal direction the flanks 31 and 32 which preferably have involute profiles preferably are shaped like arcs or arrows, i.e. they are designed like curved teeth or herringbone gears in order not to enter into engagement abruptly but rather smoothly.

What is claimed is:

1. A rotary piston engine, comprising a casing (10) in which two cylinder chambers (21, 22) are formed so as to overlap each other between an inlet (43) and an outlet (44), two shafts (17, 18), each extending through a respective one of the cylinder chambers (21, 22), and both being interconnected for rotation in an opposite sense, two complementary rotary pistons (27, 28), each fixed to a respective one of the shafts (17, 18), and each including a respective exterior face (29, 30) which is coaxial with the corresponding shaft (17, 18) said exterior faces (29, 30) periodically forming sealing zones with the casing (10) and, in the overlapping area of the two cylinder chambers (21, 22), at least one sleeve (35, 36) is arranged between each of the rotary pistons (27, 28) and the corresponding shaft (17, 18) to periodically establish sealing with respect to the complementary rotary piston (27, 28), each said sleeve (35, 36) being supported for rotation on the corresponding shaft (17, 18), and forming an exterior face (37, 38) which is coaxial with the shaft, where said exterior faces (29, 30) of each complementary piston (27, 28) periodically engage said exterior faces (37, 38) of each sleeve (35, 36) to periodically drive in rotation each said sleeve (35, 36) at a speed greater than that of the corresponding rotary piston (27, 28) and shaft (17, 18).

2. The rotary piston engine as claimed in claim 1 wherein each of the shafts (17, 18) is connected by free-wheel means (33, 34) to each of the sleeves (35, 36) it carries.

3. The rotary piston engine as claimed in claim 2, wherein each rotary piston (27, 28) is connected with the corresponding shaft (17, 18) by at least one annular web (23, 24), and each sleeve (35, 36) is sealingly arranged axially next to the corresponding web (23, 24).

4. The rotary piston engine as claimed in claim 1, wherein each rotary piston (27, 28) is connected with the corresponding shaft (17, 18) by at least one annular web (23, 24), and each said sleeve (35, 36) is sealingly arranged axially next to the corresponding web (23, 24).

5. The rotary piston engine as claimed in claim 4, wherein said two sleeves (35, 36) are separated from each other by a centrally disposed web (23, 24) and are supported on each of the shafts (17, 18), each of the sleeves (35, 36) has an end face remote from the corresponding web (23, 24) which seals against the casing (10), and the webs (23, 24) have a slightly smaller outer diameter than the corresponding sleeves (35, 36).

6. The rotary piston engine as claimed in claim 1, wherein the sleeves (35, 36) each are supported on the corresponding shaft (17, 18) by at least one bearing (33, 34), and in that the respective exterior faces (29, 38; 30, 37) adapted to periodically engage each other so that each said sleeve is periodically driven in rotation 7. The rotary piston engine as claimed in claim 6, wherein each of the shafts (17, 18) is connected by free-wheel means to each of the sleeves (35, 36) it carries.

8. The rotary piston engine as claimed in claim 6, wherein each rotary piston (27, 28) is connected with the corresponding shaft (17, 18) by at least one annular web (23, 24), and in that each sleeve (35, 36) is sealingly arranged axially next to the corresponding web (23, 24).

9. The rotary piston engine as claimed in claim 8, wherein two sleeves (35, 36) separated from each other by a centrally disposed web (23, 24) are supported on each of the shafts (17, 18), each of the sleeves (35, 36) has an end face remote from the corresponding web (23, 24) which seals against the casing (10), and the webs (23, 24) have a slightly smaller outer diameter than the corresponding sleeves (35, 36).

10. The rotary piston engine as claimed in claim 6, wherein each rotary piston (27, 28) is connected with the corresponding shaft (17, 18) by at least one annular web (23, 24), and in that each sleeve (35, 36) is sealingly arranged axially next to the corresponding web (23, 24).

11. The rotary piston engine as claimed in claim 8, wherein two sleeves (35, 36) separated from each other by a centrally disposed web (23, 24) are supported on each of the shafts (17, 18), each of the sleeves (35, 36) has an end face remote from the corresponding web (23, 24) which seals against the casing (10), and the webs (23, 24) have a slightly smaller outer diameter than the corresponding sleeve (35, 36).

12. The rotary piston engine as claimed in claim 8, wherein two sleeves (35, 36) separated from each other by a centrally disposed web (23, 24) are supported on each of the shafts (17, 18), each of the sleeves (35, 36) has an end face remote from the corresponding web (23, 24) which seals against the casing (10), and the webs (23, 24) have a slightly smaller outer diameter than the corresponding sleeves (35, 36).

* * * * *